US009180353B2

(12) United States Patent
Chen

(10) Patent No.: US 9,180,353 B2
(45) Date of Patent: Nov. 10, 2015

(54) COMPACT FOLDING SPORTS GOAL

(76) Inventor: Shaoyun Chen, Shantou (CN)

( * ) Notice: Subject to any disclaimer, the term of this patent is extended or adjusted under 35 U.S.C. 154(b) by 219 days.

(21) Appl. No.: 13/467,012

(22) Filed: May 8, 2012

(65) Prior Publication Data

US 2013/0303313 A1 Nov. 14, 2013

(51) Int. Cl.
*A63B 63/00* (2006.01)

(52) U.S. Cl.
CPC ..... *A63B 63/004* (2013.01); *A63B 2063/005* (2013.01); *A63B 2210/50* (2013.01)

(58) Field of Classification Search
CPC ..... A63B 63/004; A63B 2063/005; A63B 2210/50; A63B 2210/52; A63B 2210/54
USPC ..... 273/398–402; 473/478
See application file for complete search history.

(56) References Cited

U.S. PATENT DOCUMENTS

| | | | | |
|---|---|---|---|---|
| 5,433,433 | A | 7/1995 | Armell | |
| 5,476,266 | A * | 12/1995 | Caruso | 473/478 |
| 5,539,957 | A * | 7/1996 | Schmidt | 16/331 |
| 5,681,045 | A * | 10/1997 | Liao | 273/400 |
| 6,672,980 | B1 * | 1/2004 | Walsh | 473/478 |
| 7,125,351 | B1 | 10/2006 | Raber | |
| 7,241,235 | B2 * | 7/2007 | Caruso | 473/478 |
| 7,850,576 | B2 * | 12/2010 | Sellke | 482/51 |
| 2003/0153412 | A1 * | 8/2003 | Duba et al. | 473/478 |
| 2004/0036222 | A1 * | 2/2004 | Chou | 273/407 |
| 2007/0281805 | A1 * | 12/2007 | Hsiao | 473/407 |
| 2011/0105253 | A1 * | 5/2011 | Wennesland | 473/478 |
| 2012/0077629 | A1 * | 3/2012 | Cerasoli | 473/478 |
| 2012/0184399 | A1 * | 7/2012 | Reeves | 473/478 |

* cited by examiner

*Primary Examiner* — Mark Graham
(74) *Attorney, Agent, or Firm* — LaMorte & Associates P.C.

(57) ABSTRACT

A collapsible sports goal that can be selectively configured between an erect configuration and a folded configuration. The sports goal has six frame elements. Each of the frame elements has two opposite ends. Each end of the frame elements connects to the end of another frame element using six connector joint assemblies. Each of the joint assemblies receives and interconnects a different two of the six frame elements. Each of the connector joint assemblies contains a hinge joint that enables the frame elements connected to each of the six joint assemblies to rotate about said hinge joint between a parallel configuration to a perpendicular configuration. When all of the connector joint assemblies are in their perpendicular configuration, the sports goal is in its fully erect configuration. Conversely, when all of the connector joint assemblies are in their parallel configuration, the sports goal is in its fully folded configuration.

18 Claims, 8 Drawing Sheets

COMPACT FOLDING SPORTS GOAL

BACKGROUND OF THE INVENTION

1. Field of the Invention

In general, the present invention relates to sports goals, such as those uses as goals for soccer, hockey, lacrosse and the like. More particularly, the present invention relates to sports goals that are foldable or otherwise collapsible into a shape that is easier to store and carry.

2. Prior Art Description

Many sports, such as soccer, hockey, field hockey, lacrosse, and the like use goals that rest upon the ground. Such goals vary in dimensions depending upon the rules of the game being played. A great multitude of undersized goals also exist for use in practice and unofficial backyard play.

Regardless of the size of the goal, sports goals tend to be large and bulky. As such, sports goals are difficult to package, difficult to transport to a sports field, and difficult to carry onto a sports field. It is for these reasons that many collapsible sports goals are available in the marketplace. Collapsible sports goals are goals that are designed to be folded or disassembled when not in use. Such sports goals typically come in two styles. The first style uses a flexible spring wire as the frame of the net. The flexible wire enables a net to be folded upon itself and flattened. Such prior art sports goals are exemplified by U.S. Pat. No. 5,433,433 to Armell, entitled Flexible Sports Goal. However, the spring wire must be continuous and have curved corners in order to spring back into its unfolded shape. Accordingly, the sports net cannot have a rectangular shape that is associated with most sports goals.

Another type of collapsible sports goal is the kind designed to be quickly assembled and disassembled. These sports goals typically have straight poles and corner connectors that interconnect the various poles to form the sports goal. Such prior art sports goals are U.S. Pat. No. 7,125,351 to Raber, entitled Portable Foldable Goal Assembly. The problem associated with sports goals that are assembled on site is that it takes time and effort to erect the sports goal. Furthermore, since the sports goal comes disassembled in pieces, all the pieces must be stored and carried together. If one small piece gets misplaced, it may not be possible to properly assemble the sports goal.

A need therefore exists for a sports goal that is collapsible, yet does not disassemble. A need also exists for a sports goal that forms a goal with square corners and wherein the sports goal can be erected using very little labor and time. These needs are met by the present invention as described and claimed below.

SUMMARY OF THE INVENTION

The present invention is a collapsible sports goal that can be selectively configured between an erect configuration and a folded configuration without having to disassemble any of the sports goal. The sports goal has six frame elements. Each of the six frame elements has two opposite ends. Each ends of each frame element connects to the end of another frame element using a connector joint assembly.

Six connector joint assemblies are provided. Each of the joint assemblies receives and interconnects a different two of the six frame elements. Each of the six connector joint assemblies contains a hinge joint that enables the frame elements connected to each of the six joint assemblies to rotate about said hinge joint between a parallel configuration to a perpendicular configuration.

When all of the connector joint assemblies are in their perpendicular configuration, the sports goal is in its fully erect condition. Conversely, when all of the connector joint assemblies are in their parallel configuration, the sports goal is in its fully folded configuration.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention sports goal can be embodied in many ways, the embodiment illustrated is configured as a practice soccer goal. This embodiment is selected in order to set forth one of the best modes contemplated for the invention. The illustrated embodiment, however, is merely exemplary and should not be considered a limitation when interpreting the scope of the appended claims.

Figure 1:
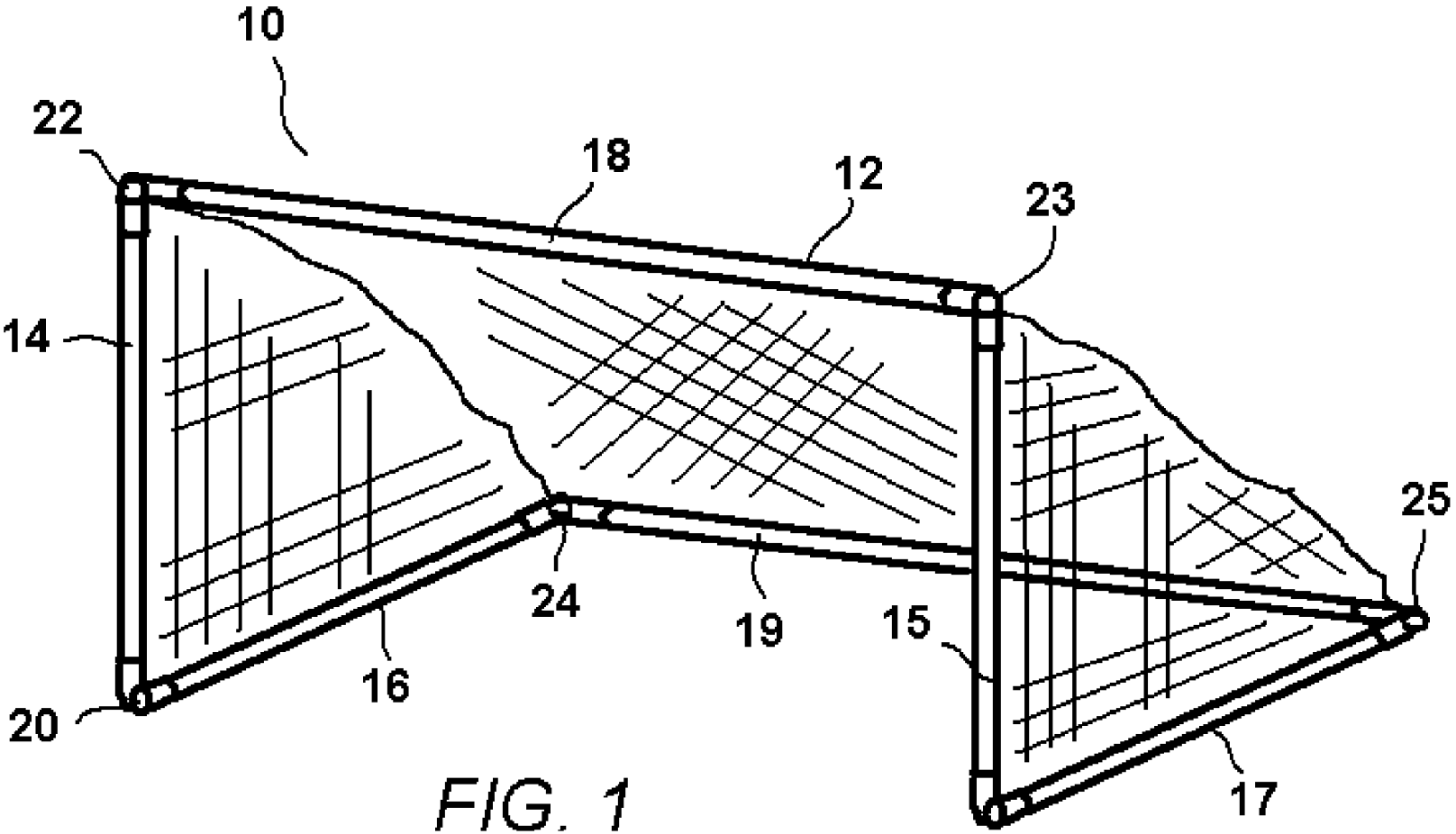
FIG. 1 is a perspective view of an exemplary embodiment of a sports goal shown in its fully erect condition.
Figure 2:
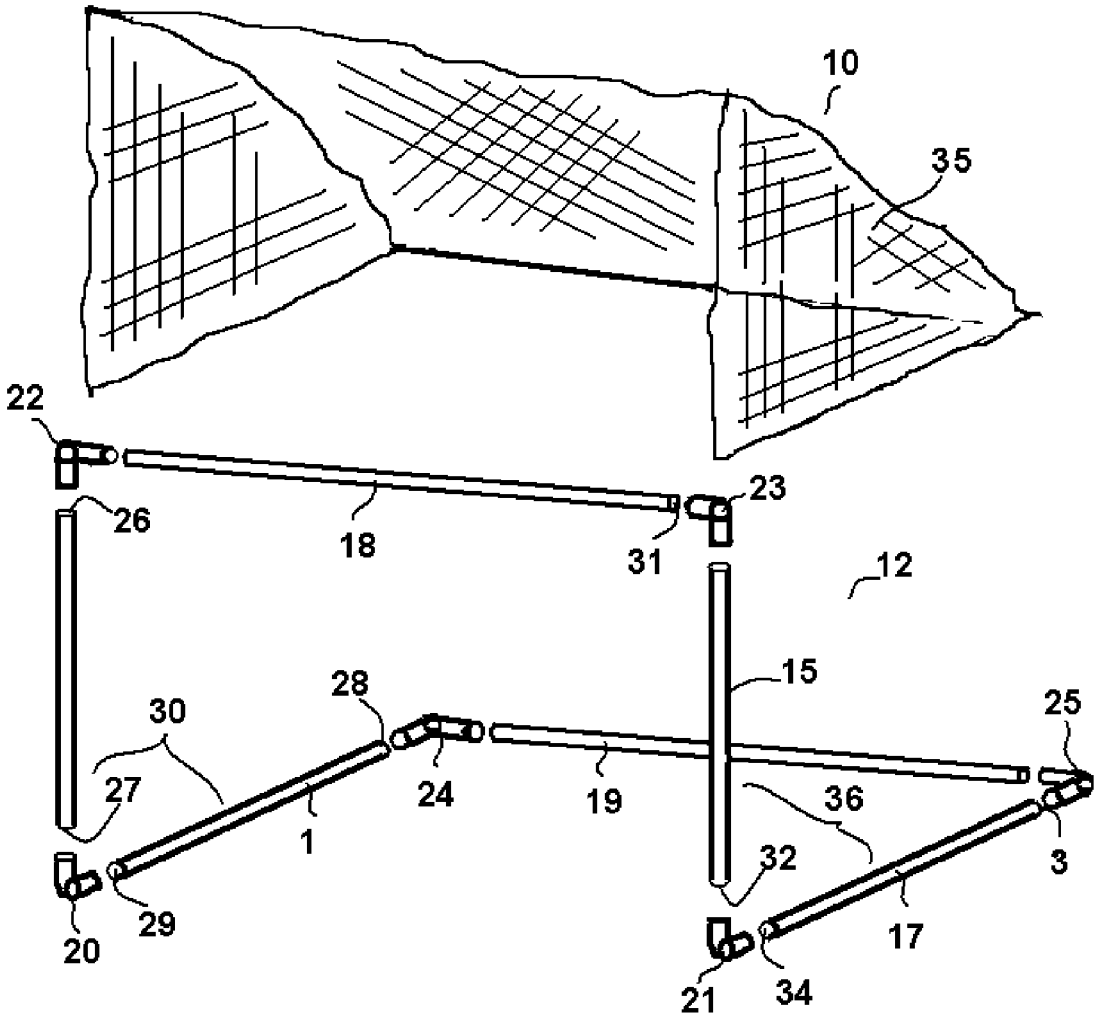
FIG. 2 is an exploded view of the exemplary embodiment of FIG. 1.

Referring to FIG. 1 in conjunction with FIG. 2, a sports goal 10 is shown. The sports goal 10 has a collapsible framework 12 that is made from six straight frame elements 14, 15, 16, 17, 18, 19 and six connector joint assemblies 20, 21, 22, 23, 24, 25. As will be later explained, the six connector joint assemblies 20, 21, 22, 23, 24, 25 are identical in shape and design, therein making the overall sports goal 10 both easy and inexpensive to manufacture.

The six frame elements 14, 15, 16, 17, 18, 19 include two vertical frame elements 14, 15, two horizontal frame elements 16, 17, a long top frame element 18, and a long bottom frame element 19. The long top frame element 18 and the long bottom frame element 19 have the same length. Likewise the vertical frame elements 14, 15 have the same length and the horizontal frame elements 16, 17 have the same length. The vertical frame elements 14, 15 and the horizontal frame elements 16, 17 are also equal in length.

The first vertical frame element 14 has a first end 26 and a second end 27. The first horizontal frame element 16 also has a first end 28 and a second end 29. The second end 27 of the first vertical frame 14 element and the second end 29 of the first horizontal frame element 16 are joined together by the first connector joint assembly 20. The first connector joint assembly 20 enables the first vertical frame element 14 and the first horizontal frame element 16 to be selectively positioned between an open configuration and a folded configuration. In the open configuration, illustrated in FIG. 1, the first vertical frame element 14 and the first horizontal frame element 16 are joined together at a perpendicular by the first connector joint assembly 20, therein forming a first L-shaped side frame structure 30. In the closed configuration, as is later illustrated in FIG. 3, the first vertical frame element 14 and the first horizontal frame element 16 lay next to each other in parallel.

The second vertical frame element 15 has a first end 31 and a second end 32. The second horizontal frame element 17 also has a first end 33 and a second end 34. The second end 32 of the second vertical frame element 15 and the second end 34 of the second horizontal frame element 17 are joined together by the second joint assembly 21. The second joint assembly 21 enables the second vertical frame element 15 and the second horizontal frame element 17 to be selectively positioned between an open configuration and a folded configuration. In the open configuration, illustrated in FIG. 1, the second vertical frame element 15 and the second horizontal frame element 17 are oriented at a perpendicular, therein forming a second L-shaped side frame structure 36. In the closed configuration, as is later illustrated in FIG. 3, the second vertical frame element 15 and the second horizontal frame element 17 lay next to each other in parallel.

Flexible netting 35 is provided that attaches to each of the frame elements 14, 15, 16, 17, 18, 19 and each of the six connector joint assemblies 20, 21, 22, 23, 24, 25. The netting 35 is flexible enough not to hinder the folding and unfolding of the sports goal 10.

The long top frame element 18 extends between the first end 26 of the first vertical frame element 14 and the first end 31 of the second vertical frame element 15. The long top frame element 18 engages the first end 26 of the first vertical frame element 14 with the third connection joint assembly 22. The opposite end of the long top frame element 18 engages the first end 31 of the second vertical frame element 15 with the fourth connection joint assembly 23. When the sport goal 10 is fully erect, such as is shown in FIG. 1, the first vertical frame element 14, the second vertical frame element 15, and the long top frame element 18 form three sides of the rectangular front opening of the sports goal 10.

The long bottom frame element 19 extends between the first end 28 of the first horizontal frame element 16 and the first end 33 of the second horizontal frame element 17. The long bottom frame element 19 engages the first end 28 of the first horizontal frame element 16 with the fifth connection joint assembly 24. The opposite end of the long bottom frame element 19 engages the first end 33 of the second horizontal frame element 17 with the sixth connection joint assembly 25. When the sport goal 10 is fully erect, such as is shown in FIG. 1, the first horizontal frame element 16, the second horizontal frame element 17, and the long bottom frame element 19 form three sides of the rectangular base of the sports goal.

Figure 3:
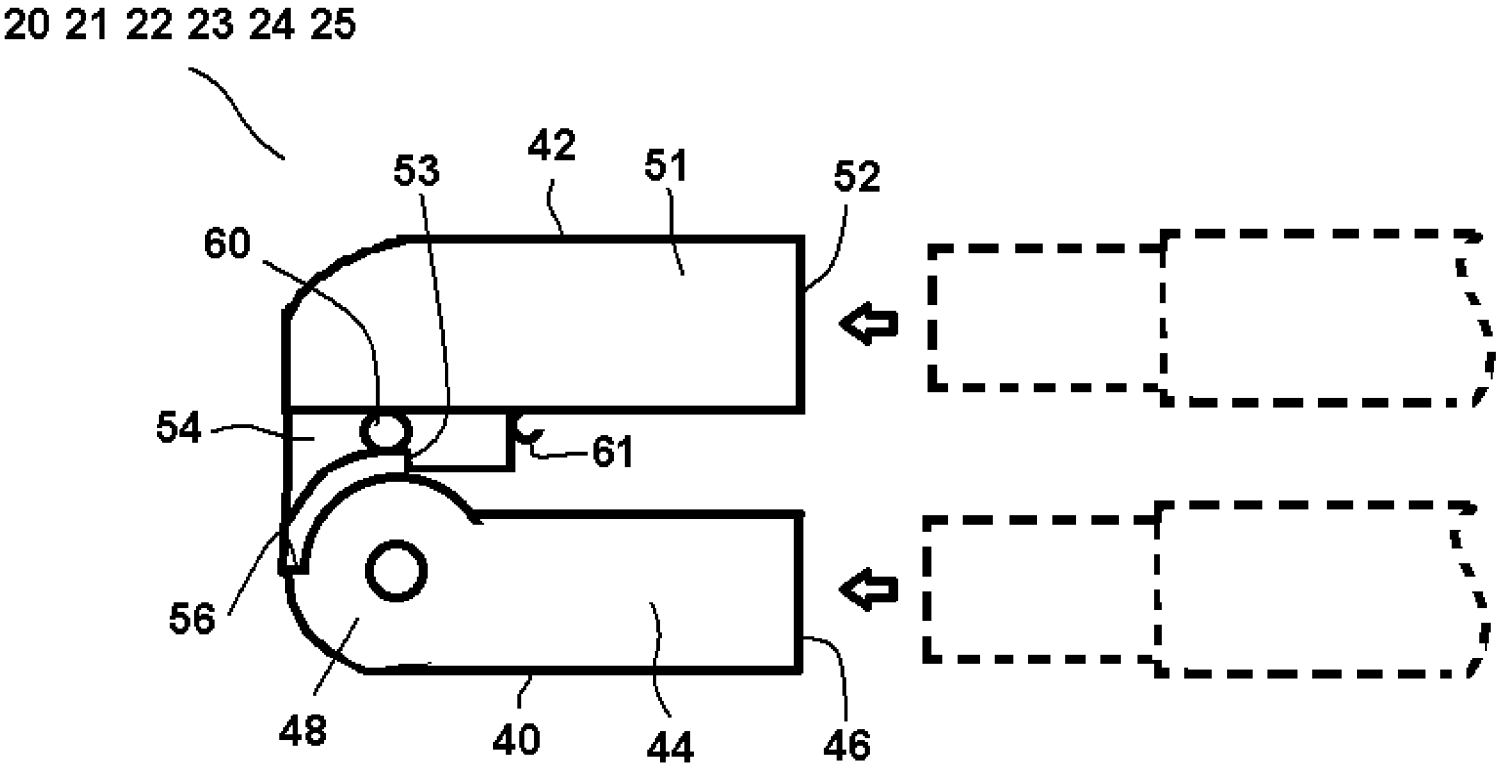
FIG. 3 is top view of a connector joint assembly shown in its parallel configuration.
Figure 4:
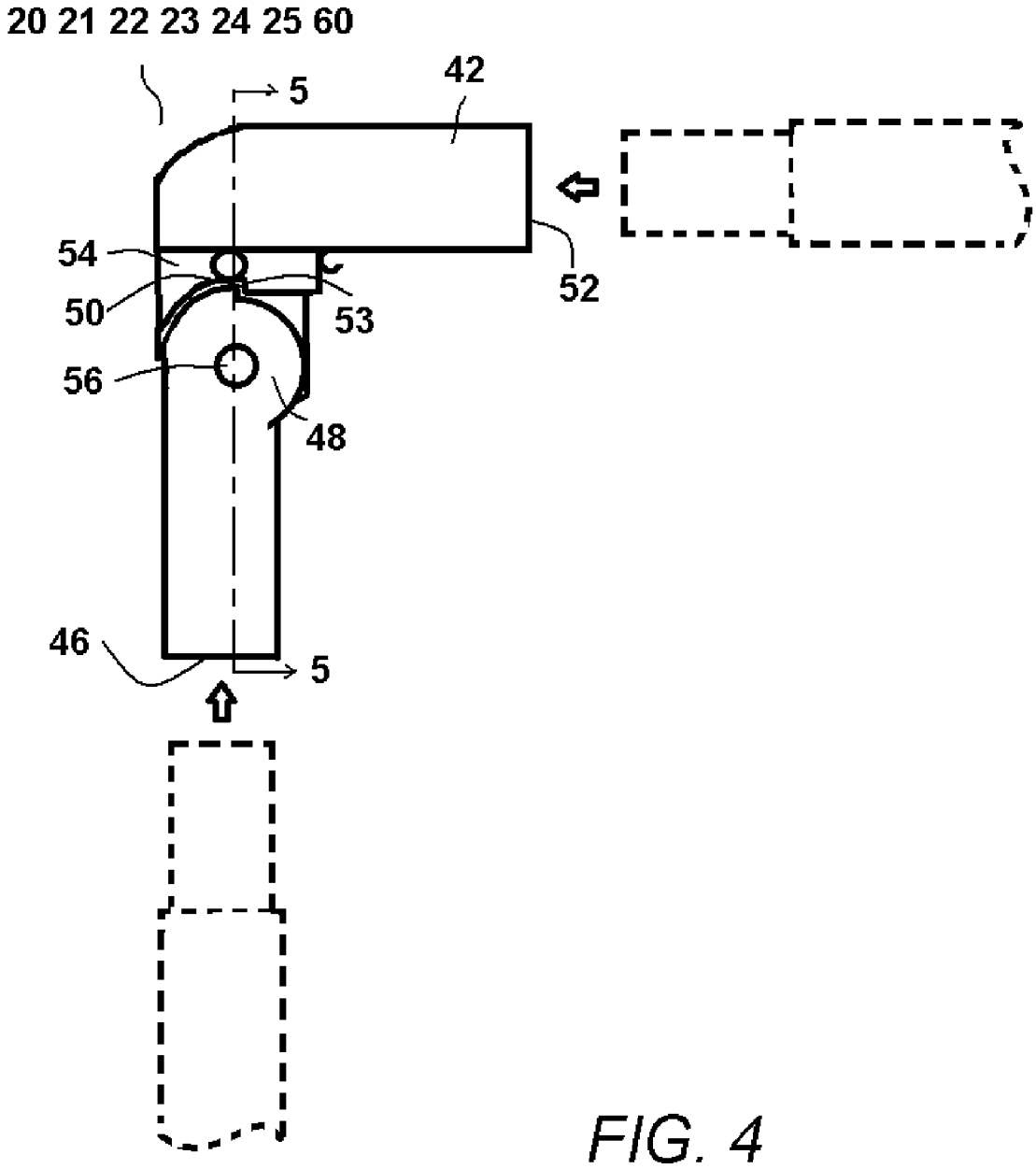
FIG. 4 is a top view of a connector joint assembly shown in its perpendicular configuration.
Figure 5:
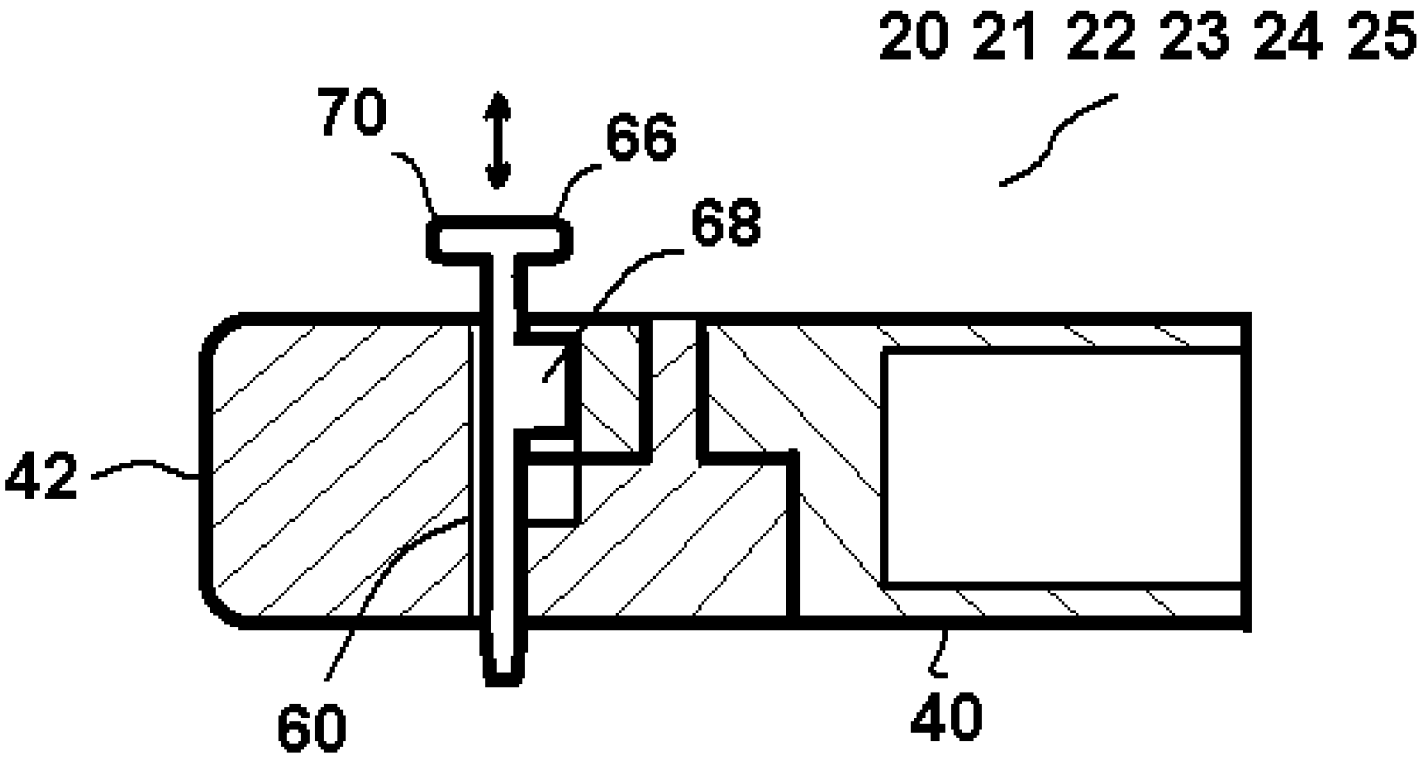
FIG. 5. is a cross-sectional view of the connector joint assembly viewed along line 5-5 of FIG. 4.

It will be understood that six separate connector joint assemblies 20, 21, 22, 23, 24, 25 are utilized within the sports goal 10. All six of the connector joint assemblies 20, 21, 22, 23, 24, 25 are identical in structure. Referring to FIG. 3, FIG. 4 and FIG. 5, in conjunction with FIG. 2, the common design of each of the connector joint assemblies 20, 21, 22, 23, 24, is described. Each connector joint assembly 20, 21, 25 is described. Each connector joint assembly 20, 21, 22, 23, 24, 25 has a straight leg 40 and an L-shaped leg 42. The straight leg 40 of each connector joint assembly has a shaft 44 with an open end 46 that is shaped and sized to receive one of the frame elements 14, 15, 16, 17, 18, 19 previously described. A frame element can be retained in the open end 46 by adhesive or by a mechanical fastener, such as a screw. The opposite end of the shaft 44 of the straight leg 40 terminates with an annular hinge barrel 48. A stop projection 50 extends from the periphery of the annular hinge barrel 48.

Each connection joint assembly 20, 21, 22, 23, 24, also includes the L-shaped leg 42. The L-shaped leg 42 has a shaft 51 with an open end 52 that is shaped and sized to receive one of the frame elements 14, 15, 16, 17, 18, 19 previously described. The frame elements can be retained in the open end 52 by adhesive or by a mechanical fastener, such as a screw. A hinge plate 54 extends laterally from the bottom of the shaft 50. A hinge pin 56 extends up from the center of the hinge plate 54.

A space exists between the straight shaft 50 and the hinge plate 54. A locking pin aperture 60 is formed within this space 58. The locking pin aperture 60 extends completely through the connector joint assembly.

Each of the connector joint assemblies also includes a hook 61 for engaging and retaining a segment of the flexible net 35.

When the connector joint assembly is assembled, the annular hinge barrel 48 of the straight leg 40 passes over the hinge pin 56 of the L-shaped leg 42 to create a hinged joint 62. The hinge joint 62 enables the straight leg 40 and the L-shaped leg 42 to move relative one another from a parallel configuration shown in FIG. 4 to the perpendicular configuration shown in FIG. 3. The offset position of the hinge pin 56 on the L-shaped leg 42 enables the shaft 44 of the straight leg 40 and the shaft 50 of the L-shaped leg 42 to be parallel when in the parallel configuration. The stop projection 50 on the straight leg 40 engages a ledge 53 formed into the L-shaped leg 42 when the two legs 40, 42 are turned to their perpendicular configuration.

A locking pin 66 is provided. The locking pin 66 extends into the locking pin aperture 60 in the L-shaped leg 42. The locking pin 66 has a keyed body 68 and an enlarged head 70 that enables the locking pin 66 to be manually raised and lowered within the locking pin aperture 60. When the locking pin 66 is lowered in the locking pin aperture 60, the keyed body 68 interlocks the straight leg 40 with the L-shaped leg 42. The locking pin 56 is lowered when the straight arm 40 and the L-shaped arm 42 of a connector joint assembly are in their perpendicular configuration. This locks the two arms 40, 42 into this configuration and prevents each connector hinge joint from inadvertently closing toward its parallel configuration.

From the above description, it will be understood that each of the connector joint assemblies 20, 21, 22, 23, 24, 25 is capable of moving between a parallel configuration, where it holds two framing elements in parallel, to a perpendicular orientation, where it hold holds two framing elements at a right angle. Furthermore, once a connector joint assembly is in its perpendicular configuration, it can be selectively locked into that configuration.

Figure 6:
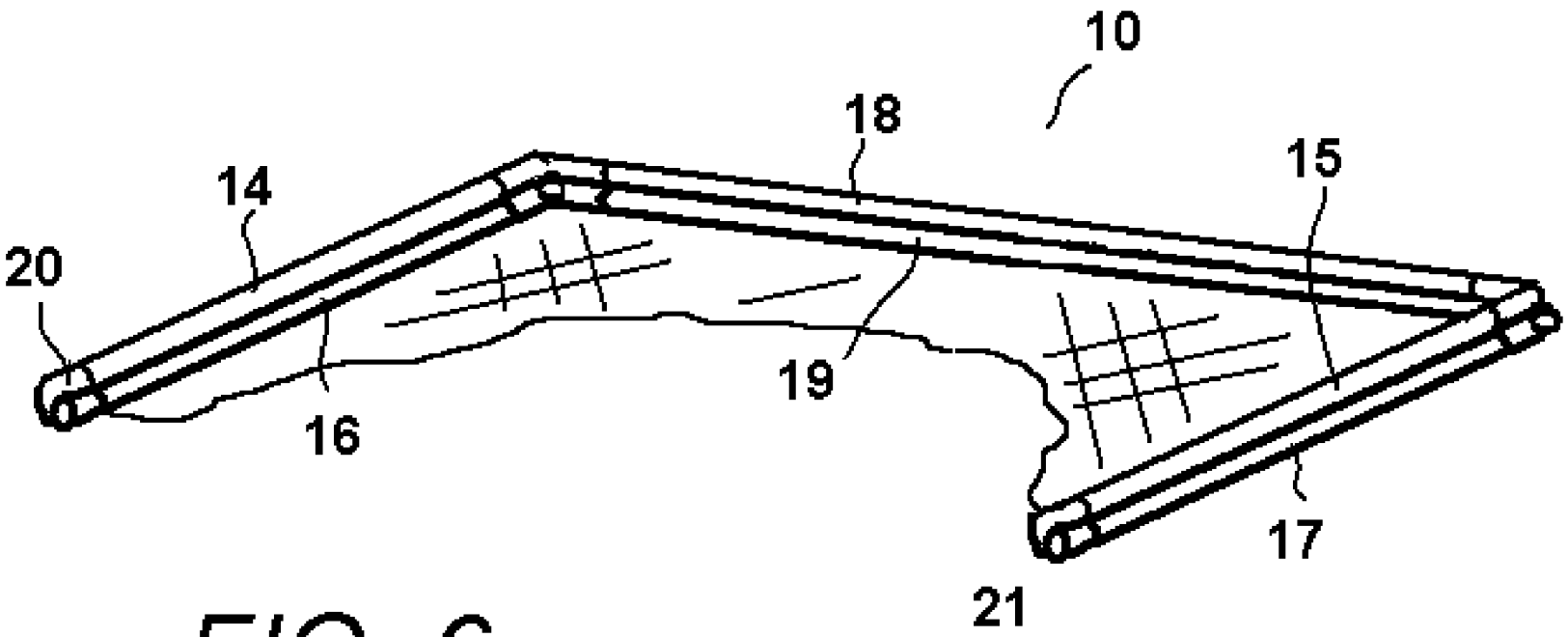
FIG. 6 is a perspective view of the sports goal in a partially folded condition.

Referring now to FIG. 6 in conjunction with the earlier figures, it can be seen that in order to collapse the sports goal 10, the locking pins 66 in the first and second connector joint assemblies 20, 21 are depressed so that the first and second connector joint assemblies 20, 21 can rotate from a perpendicular configuration to a parallel configuration. This causes the first and second vertical framing elements 14, 15 to fall flat atop the first and second horizontal framing elements 16, 17, respectively. It also causes the long top framing element 18 to fall flat atop the long bottom frame element 19.

Figure 7:
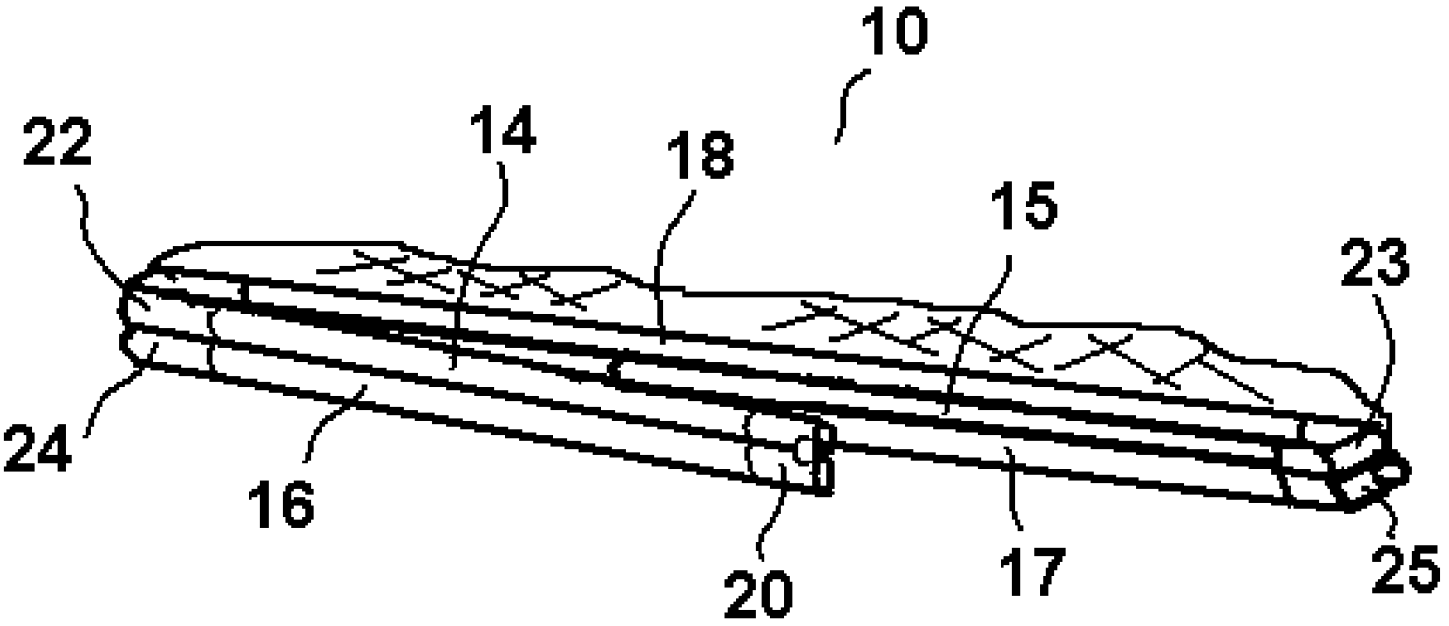
FIG. 7 is a perspective view of the sports goal in a fully folded condition.

Referring now to FIG. 7 in conjunction with the earlier figures, it can be seen that the locking pins 66 in the third, fourth fifth and sixth connection joint assemblies 22, 23, 24, 25 are depressed so that these connection joint assemblies 22, 23, 24, 25 can move from a perpendicular configuration to a parallel configuration. This enables the first vertical frame element 14 and the first horizontal frame element 16 to move as a unit against the long top frame element 18 and the long bottom frame element 19 so that the four frame elements 14, 16, 18, 19 are parallel.

Lastly, the second vertical framing element 15 and the second horizontal framing element 17 can rotate as a unit against the first vertical framing element 14 and the first horizontal framing element 16. The end result, shown in FIG. 7, is a highly compact sports goal 10 that has not been disassembled, yet is very readily packaged or transported. In order to open the sports goal 10 back to its fully erected configuration, the folding steps previously described are reversed. All six connector joint assemblies 20, 21, 22, 23, 24, 25 are manipulated into their perpendicular configurations and are locked. This causes the sports goal 10 to be configured in the manner of FIG. 1.

It has been stated, that the sports goal 10 can be manufactured in a wide variety of dimensions. In some variations of the sports goal 10 it is possible for the netting to inhibit the folding and unfolding of the sports goal 10. To promote the smooth folding and opening of the sports goal 10, a dynamic connection system can be used to connect the netting to the framing elements.

Figure 8:
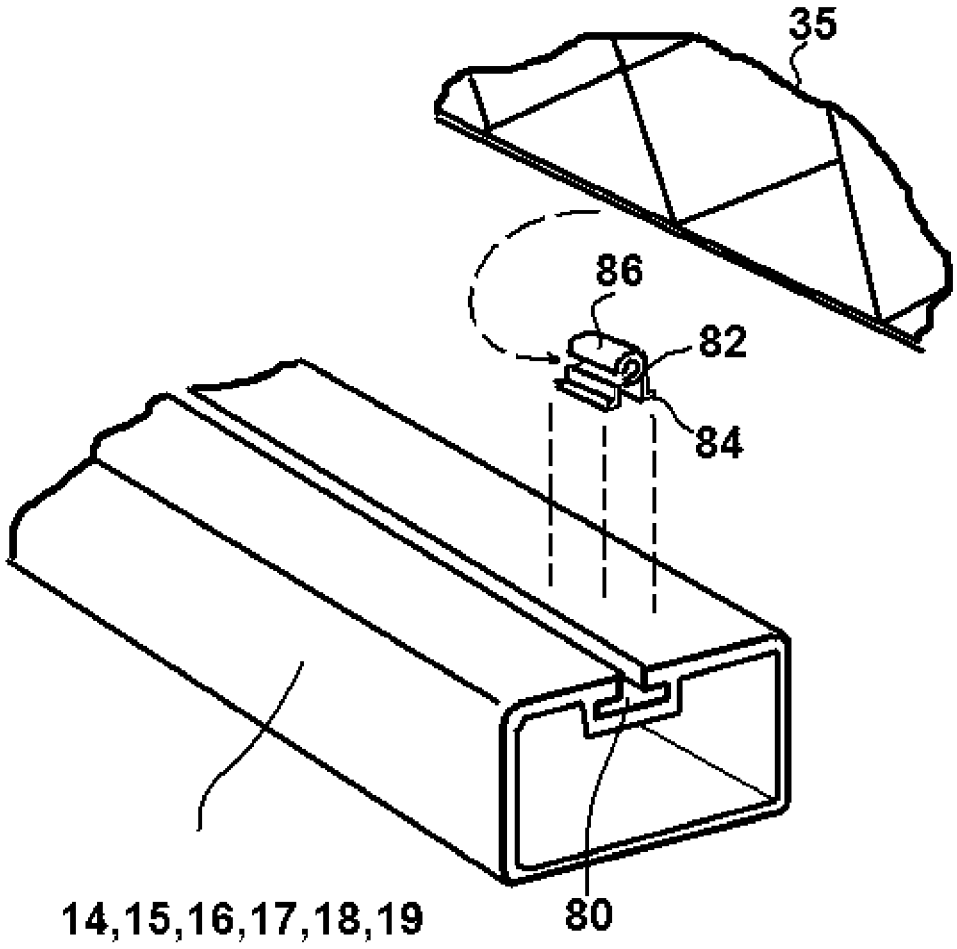
FIG. 8 is a fragments view of a framing element used to illustrate an arrangement for connecting the netting to the framing element.

Referring to FIG. 8, is can be seen that each of the frame elements 14, 15, 16, 17, 18, 19 can be made with a T-slot 80 that runs the length of that frame elements 14, 15, 16, 17, 18, 19. A plurality of hook slides 82 are provided. Each of the hook slides 82 has an expanded base 84 that fits into the T-slot 80. Once the base 84 of a hook slide 82 is engaged with the T-slot 80, the hook slide 82 is free to reciprocally move along the length of the T-slot 80.

Each hook slide 82 also has a hooked head 86 that extends above the T-slot 80. The hooked head 86 engages the cording of the flexible netting 35. Thus, the hook slides 82 connect the flexible netting 35 to the various frame elements 14, 15, 16, 17, 18, 19. Since the hooks slides 82 connect the flexible netting 35 to the frame elements 14, 15, 16, 17, 18, 19 and the hook slides 82 are free to move along the length of the frame elements 14, 15, 16, 17, 18, 19, it will be understood that the points where the netting attaches to the frame elements 14, 15, 16, 17, 18, 19 can vary as the hook slides 82 move. The hook slides 82 will move in the T-slots 80 in the direction of least resistance as the sports goal 10 is opened and closed. This enables the sport goal 10 to better open and close without and resistance from the flexible netting 35.

It will be understood that the embodiment of the present invention that is illustrated and described is merely exemplary and that a person skilled in the art can make many variations to that embodiment. For instance, the lengths of the various framing elements can be varied as a matter of design choice. All such embodiments are intended to be included within the scope of the present invention as defined by the claims.

What is claimed is:

1. A collapsible sports goal comprising:

six frame elements, wherein each of said frame elements has two ends;

six connector joint assembles that interconnect said six frame elements at said ends of said six frame elements, wherein each of said joint assemblies receives and interconnects two separate frame elements from said six frame elements, wherein each of said connector joint assemblies has a first leg with a first open ended shaft, and a second leg with a second open ended shaft, wherein said first open ended shaft and said second open ended shaft receive said two separate frame elements, and wherein each said second leg has a hinge plate that extends laterally from said second open ended shaft, wherein said first open ended shaft connects to said hinge plate at a hinge joint that enables said two separate frame elements connected to each of said six joint assembles to rotate about said hinge joint between a parallel configuration and a perpendicular configuration, and a locking pin having a keyed body in each of said connector joint assemblies that extends into said hinge plate between said first open shaft and said second open shaft, said locking pin being selectively positionable between a first position and a second position, wherein when in said first position, said first open ended shaft and said second open ended shaft are free to rotate about said hinge joint between said parallel configuration and said perpendicular configuration, and wherein when in said second position said first open ended shaft and said second open ended shaft are locked in said perpendicular configuration.

2. The sports goal according to claim 1, wherein each of said six connector joint assemblies are identical.

3. The sports goal according to claim 1, wherein said six frame elements include two vertical frame elements, two horizontal frame elements, a top frame element and a bottom frame element, wherein said two vertical frame elements and said two horizontal frame elements share a common length.

4. The sports goal according to claim 3, wherein said top frame element and said bottom frame element share a common length.

5. The sports goal according to claim 3, wherein said sports goal stands in a fully erect condition when all of said six connector joint assemblies are in said perpendicular configuration.

6. The sports goal according to claim 5, wherein said top frame element is coplanar with both of said vertical frame elements and interconnects said vertical frame elements when said sports goal stands in said fully erect condition.

7. The sports goal according to claim 5, wherein said bottom frame element is coplanar with both of said horizontal frame elements and interconnects said horizontal frame elements when said sports goal stands in said fully erect condition.

8. The sports goal according to claim 3, wherein said sports goal is in a compact folded condition when all of said six connector joint assemblies are in said parallel configuration.

9. The sports goal according to claim 8, wherein said two vertical frame elements lay in parallel atop said two horizontal frame elements when said sports goal is in said folded condition.

10. The sports goal according to claim 8, wherein said top frame element lay in parallel atop said bottom frame element when said sports goal is in said folded condition.

11. The sports goal according to claim 8, wherein a first vertical frame element of said to vertical frame elements lay parallel to said top frame element when said sports goal is in said folded condition.

12. A collapsible sports goal comprising:

a first vertical frame element and a second vertical frame element;

a first horizontal frame element and a second horizontal frame element;

a top frame coupled to said first vertical frame element with a first connector joint assembly and coupled to said second vertical frame element with a second connector joint assembly;

a bottom frame element coupled to said first horizontal frame element with a third connector joint assembly and coupled to said second horizontal frame element with a fourth connector joint assembly;

wherein said first vertical frame element is coupled to said first horizontal frame element with a fifth connector joint assembly and said second vertical frame element is coupled to said second horizontal frame element with a sixth connector joint assembly;

wherein said first connector joint assembly, said second connector joint assembly, said third connector joint assembly, said fourth connector joint assembly, said fifth connector joint assembly and said sixth connector joint assembly all contain a first leg with a first open ended shaft, and a second leg with a second open ended shaft, wherein each said second leg has a hinge plate that extends laterally from said second open ended shaft, and wherein said first open ended shaft connects to said hinge plate at a hinge joint that enables said first open ended shaft and said second open ended shaft to rotate between a parallel configuration and a perpendicular configuration, and a locking pin having a keyed body extending into each said hinge plate between said first open shaft and said second open shaft, said locking pin being selectively positionable between a first position and a second position, wherein when in said first position, said first open ended shaft and said second open ended shaft are free to rotate about said hinge joint between said parallel configuration and said perpendicular configuration, and wherein when in said second position said first open ended shaft and said second open ended shaft are locked in said perpendicular configuration.

13. The sports goal according to claim 12, wherein said first connector joint assembly, said second connector joint assembly, said third connector joint assembly, said fourth connector joint assembly, said fifth connector joint assembly and said sixth connector joint assembly are all identical.

14. The sports goal according to claim 12, wherein said sports goal stands in a fully erect condition when said first connector joint assembly, said second connector joint assembly, said third connector joint assembly, said fourth connector joint assembly, said fifth connector joint assembly and said sixth connector joint assembly all are in said perpendicular configuration.

15. The sports goal according to claim 14, wherein said top frame element is coplanar with both of said vertical frame elements and interconnects said vertical frame elements when said sports goal stands in said fully erect condition.

16. The sports goal according to claim 14, wherein said bottom frame element is coplanar with both of said horizontal frame elements and interconnects said horizontal frame elements when said sports goal stands in said fully erect condition.

17. The sports goal according to claim 12, wherein said sports goal is in a compact folded condition when said first connector joint assembly, said second connector joint assembly, said third connector joint assembly, said fourth connector joint assembly, said fifth connector joint assembly and said sixth connector joint assembly are all in said parallel configuration.

18. The sports goal according to claim 17, wherein said first vertical frame element, said second vertical frame element, said first horizontal frame element, said second horizontal frame element, said top frame element and said bottom frame element all contain slots, wherein hook slides are positioned in said slots and are free to move reciprocally within said slots, wherein flexible netting is connected to all of said hook slides.

* * * * *